US009299554B2

(12) United States Patent
Neate

(10) Patent No.: US 9,299,554 B2
(45) Date of Patent: Mar. 29, 2016

(54) LUCENT WAVEGUIDE ELECTROMAGNETIC WAVE

(71) Applicant: Ceravision Limited, Milton Keynes (GB)

(72) Inventor: Andrew Simon Neate, Mentmore (GB)

(73) Assignee: Ceravision Limited, Milton Keynes (GB)

( * ) Notice: Subject to any disclaimer, the term of this patent is extended or adjusted under 35 U.S.C. 154(b) by 0 days.

(21) Appl. No.: 14/400,266

(22) PCT Filed: May 3, 2013

(86) PCT No.: PCT/GB2013/051170
§ 371 (c)(1),
(2) Date: Nov. 10, 2014

(87) PCT Pub. No.: WO2013/167879
PCT Pub. Date: Nov. 14, 2013

(65) Prior Publication Data

US 2015/0097481 A1 Apr. 9, 2015

(30) Foreign Application Priority Data

May 10, 2012 (GB) ..... 1208368.9

(51) Int. Cl.
*H01J 65/04* (2006.01)
*H01J 5/16* (2006.01)
*H01Q 1/26* (2006.01)

(52) U.S. Cl.
CPC ..... *H01J 65/044* (2013.01); *H01J 5/16* (2013.01); *H01Q 1/26* (2013.01)

(58) Field of Classification Search
CPC ..... H01J 5/16; H01J 65/044; H01Q 1/26
See application file for complete search history.

(56) References Cited

U.S. PATENT DOCUMENTS

2010/0194257 A1* 8/2010 Neate ..... H01J 65/044 313/114
2011/0204781 A1 8/2011 Espiau

FOREIGN PATENT DOCUMENTS

WO 2012004557 1/2012

* cited by examiner

*Primary Examiner* — Douglas W Owens
*Assistant Examiner* — Raymond R Chai
(74) *Attorney, Agent, or Firm* — Bay State IP, LLC

(57) ABSTRACT

A Lucent Waveguide Electromagnetic Wave Plasma Light Source has a fabrication (1) of quartz with an inner closed void enclosure (2) is formed of 8 mm OD, 4 mm ID drawn tube. It is sealed at its inner and outer ends (3,4). Microwave excitable plasma material is sealed inside the enclosure. Its outer end (4) protrudes through an end plate (5) by approximately 10.5 mm and the overall length of the enclosure is approximately 20.5 mm. The tube (71) from which the void is formed is continued backwards from the inner end of the void enclosure as an antenna sheath (72). The 2 mm thick end plate (5) is circular and has the enclosure (2) sealed in a central bore in it.

38 Claims, 8 Drawing Sheets

LUCENT WAVEGUIDE ELECTROMAGNETIC WAVE

CROSS REFERENCE TO RELATED APPLICATION

This application is for entry into the U.S. National Phase under §371 for International Application No. PCT/GB2013/051170 having an international filing date of May 3, 2013, and from which priority is claimed under all applicable sections of Title 35 of the United States Code including, but not limited to, Sections 120, 363, and 365(c), and which in turn claims priority under 35 USC 119 to United Kingdom Patent Application No. 1208368.9 filed on May 10, 2012.

BACKGROUND OF THE INVENTION

1. Field of the Invention

The present invention relates to a Lucent Waveguide Electromagnetic Wave Plasma Light Source.

2. Description of the Related Art

In our European Patent No. EP2188829—Our '829 Patent, there is described and claimed (as granted):

A light source to be powered by microwave energy, the source having:

- a body having a sealed void therein,
  - a microwave-enclosing Faraday cage surrounding the body,
- the body within the Faraday cage being a resonant waveguide,
- a fill in the void of material excitable by microwave energy to form a light emitting plasma therein, and
- an antenna arranged within the body for transmitting plasma-inducing, microwave energy to the fill, the antenna having:
  - a connection extending outside the body for coupling to a source of microwave energy;

wherein:

- the body is a solid plasma crucible of material which is lucent for exit of light therefrom, and
- the Faraday cage is at least partially light transmitting for light exit from the plasma crucible, the arrangement being such that light from a plasma in the void can pass through the plasma crucible and radiate from it via the cage.

As used in Our '829 Patent:

"lucent" means that the material, of the item which is described as lucent, is transparent or translucent—this meaning is also used in the present specification in respect of its invention;

"plasma crucible" means a closed body enclosing a plasma, the latter being in the void when the void's fill is excited by microwave energy from the antenna.

We describe the technology protected by Our '829 Patent as our "LER" technology.

In our patent application No. PCT/GB2011/001744 (our '744 Application), we defined an LUWPL as follows:

A microwave plasma light source having:

- a fabrication of solid-dielectric, lucent material, having;
  - a closed void containing electro-magnetic wave, normally microwave, excitable material; and
- a Faraday cage:
  - delimiting a waveguide,
  - being at least partially lucent, and normally at least partially transparent, for light emission from it,
  - normally having a non-lucent closure and
  - enclosing the fabrication;

- provision for introducing plasma exciting electro-magnetic waves, normally microwaves, into the waveguide;

the arrangement being such that on introduction of electromagnetic waves, normally microwaves, of a determined frequency a plasma is established in the void and light is emitted via the Faraday cage.

For the purposes of this specification, we define "microwave" to mean the three order of magnitude range from around 300 MHz to around 300 GHz. We anticipate that the 300 MHz lower end of the microwave range is above that at which a LUWPL of the present invention could be designed to operate, i.e. operation below 300 MHz is envisaged. Nevertheless we anticipate based on our experience of reasonable dimensions that normal operation will be in the microwave range. We believe that it is unnecessary to specify a feasible operating range for the present invention.

In our existing LUWPLs, the fabrication can be of continuous solid-dielectric material between opposite sides of the Faraday cage (with the exception of the excitable-material, closed void) as in a lucent crucible of our LER technology. Alternatively it can be effectively continuous as in a bulb in a bulb cavity of the "lucent waveguide" of our Clam Shell. Alternatively again fabrications of as yet unpublished applications on improvements in our technology include insulating spaces distinct from the excitable-material, closed void.

Accordingly it should be noted that whereas terminology in this art prior to our LER technology includes reference to an electroplated ceramic block as a waveguide and indeed the lucent crucible of our LER technology has been referred to as a waveguide; in the this specification, we use "waveguide" to indicate jointly:

- the enclosing Faraday cage, which forms the wave guide boundary,
- the solid-dielectric lucent material fabrication within the cage,
- other solid-dielectric material, if any, enclosed by the Faraday cage and
- cavities and/or empty portions, if any, enclosed by the Faraday cage and devoid of solid dielectric material, the solid-dielectric material, together the effect of the plasma and the Faraday cage, determining the manner of propagation of the waves inside the cage.

Insofar as the lucent material may be of quartz and/or may contain glass, which materials have certain properties typical of solids and certain properties typical of liquids and as such are referred to as super-cooled liquids, super-cooled liquids are regarded as solids for the purposes of this specification.

Also for the avoidance of doubt "solid" is used in the context of the physical properties of the material concerned and not to infer that the component concerned is continuous as opposed to having voids therein.

There is a further clarification of terminology required. Historically a "Faraday cage" was an electrically conductive screen to protect occupants, animate or otherwise, from external electrical fields. With scientific advance, the term has come to mean a screen for blocking electromagnetic fields of a wide range of frequencies. A Faraday cage will not necessarily block electromagnetic radiation in the form of visible and invisible light. Insofar as a Faraday cage can screen an interior from external electromagnetic radiation, it can also retain electromagnetic radiation within itself. Its properties enabling it to do the one enable it to do the other. Whilst it is recognised that the term "Faraday cage" originates in respect of screening interiors, we have used the term in our earlier LUWPL patents and applications to refer to an electrical screen, in particular a lucent one, enclosing electromagnetic waves within a waveguide delimited by the cage. We continue with this use in this present specification.

In that application—our '744 Application—we described and claimed in first aspect, a LUWPL for our now so-called LEX technology, as follows:

A Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

the arrangement being such that there is:

a first region of the waveguide space extending between opposite sides of the Faraday cage at this region, this first region:

accommodating the inductive coupling means and having a relatively high volume average dielectric constant and a second region of the waveguide space extending between opposite sides of the Faraday cage at this region, this second region:

having a relatively low volume average dielectric constant.

In this specification, this is called a first aspect LEX LUWPL.

SUMMARY OF THE INVENTION

The object of the present invention is to provide an improved LEX LUWPL.

According to a first aspect of the present invention, there is provided a first aspect LEX LUWPL, in which the at least partially inductive coupling means for introducing plasma exciting electromagnetic waves into the waveguide extends out of the first region and into the second region.

In other words, according to the first aspect of the present invention, there is provided:

A Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

at least substantially enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

the arrangement being such that there is:

a first region of the waveguide space extending between opposite sides of the Faraday cage at this region, this first region:

at least partially accommodating the inductive coupling means and having a relatively high volume average dielectric constant and a second region of the waveguide space extending between opposite sides of the Faraday cage at this region, this second region:

having a relatively low volume average dielectric constant and being occupied by:

the fabrication of solid-dielectric, lucent material and either the closed void containing electromagnetic wave excitable plasma material alone or the closed void containing electromagnetic wave excitable plasma material and a cavity within the fabrication or the closed void containing electromagnetic wave excitable plasma material and an empty portion of the waveguide space between the fabrication and the Faraday cage or the closed void containing electromagnetic wave excitable plasma material and both a cavity within the fabrication and an empty portion of the waveguide space between the fabrication and the Faraday cage;

wherein:

the at least partially inductive coupling means for introducing plasma exciting electromagnetic waves into the waveguide extends out of the first region and into the second region.

Preferably:

the at least partially inductive coupling means extends to a position in the second region of the waveguide space at which a portion of the second region unoccupied solid-dielectric material is present between the coupling means and the Faraday cage;

a solid-dielectric material surface extends at least substantially between opposite sides of the Faraday cage, preferably as a face of the lucent material of the fabrication, as an interface between the first and second regions of the waveguide space.

Whilst the antenna could extend through an aperture in a back wall of the fabrication and into a cavity therein without any sheath and the antenna could be sealed in the back wall; preferably, the antenna extends into the fabrication within a sheathing tube, conveniently of the material of the fabrication.

In preferred embodiments the sheathing tube is the same tube which has the plasma void formed in it beyond a seal from the antenna.

Also in our '744 Application we claimed in a second aspect, a LUWPL for our now so-called LEX technology, as follows:

A Lucent Waveguide Electromagnetic Wave Plasma Light Source comprising:

a fabrication of solid-dielectric, lucent material, the fabrication providing at least:

an enclosure of a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space and the waveguide space having:

an axis of symmetry; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the arrangement is such that with the waveguide space notionally divided into equal front and rear semi-volumes:

the front semi-volume is:

at least partially occupied by the fabrication with the said void in the front semi-volume and is enclosed (except at the rear semi-volume) by a front, lucent portion of the Faraday cage via which portion light from the void can radiate, the rear semi-volume has the inductive coupler extending in it and the volume average of the dielectric constant of the content of the front semi-volume is less than that of the rear semi-volume.

In this specification, this is called a second aspect LEX LUWPL.

According to a second aspect of the present invention, there is provided a second aspect LEX LUWPL, in which the at least partially inductive coupling means for introducing plasma exciting electromagnetic waves into the waveguide extends out of the rear semi-volume and into the front semi-volume.

Also in our '744 Application we claimed in a third aspect, A Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the fabrication is of quartz and a body of alumina is provided in the waveguide space to raise the volume average of the dielectric constant of the waveguide space, the inductive coupling means being provided in the alumina body.

In this specification, this is called a third aspect LEX LUWPL.

According to a third aspect of the present invention, there is provided a third aspect LEX LUWPL, in which the at least partially inductive coupling means for introducing plasma exciting electromagnetic waves into the waveguide extends out of the alumina body and into the quartz fabrication.

Also in our '744 Application we claimed in a fourth aspect, A Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the volume average of the dielectric constant of the fabrication is less that the dielectric constant of its material.

In this specification, this is called a fourth aspect LEX LUWPL.

According to a fourth aspect of the present invention, there is provided a fourth aspect LEX LUWPL, in which the at least partially inductive coupling means for introducing plasma exciting electromagnetic waves into the waveguide extends into the fabrication having the closed void.

Also in our '744 Application we claimed in a fifth aspect, A Lucent Waveguide Electromagnetic Wave Plasma Light Source comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

a body of solid dielectric material in the waveguide space, the body abutting the fabrication and having the inductive coupling means extending in it, whereby on introduction of electromagnetic waves of a determined frequency a plasma is established in the void and light is emitted via the Faraday cage.

In this specification, this is called a fifth aspect LEX LUWPL.

According to a fifth aspect of the present invention, there is provided a fifth aspect LEX LUWPL, in which the at least partially inductive coupling means for introducing plasma exciting electromagnetic waves into the waveguide extends out of the said body and into the second fabrication.

Also in our '744 Application we claimed in a sixth aspect, A light emitter for use with a source of electromagnetic waves, an antenna and a Faraday cage, the light emitter comprising:

- an enclosure of lucent material, having at least one outer wall and a back wall;
- a cavity within the enclosure;
- an excitable-material-containing bulb extending into the cavity from at least one of the walls of the cavity, the bulb having a void containing excitable material and
- a body of solid dielectric material fitted to the enclosure, having a front face complementary with the back wall of the cavity and an antenna bore;

the arrangement of the light emitter being such that the combination of the enclosure including the bulb and the body, when surrounded by the Faraday cage, form an electro-magnetically resonant system in which resonance can be established by application of electromagnetic waves to the antenna in the bore for emission of light from a plasma in the excitable material.

In this specification, this is called a sixth aspect LEX LUWPL.

According to a sixth aspect of the present invention, there is provided a sixth aspect LEX LUWPL, in which the antenna extends out of the said body and into the enclosure.

For the avoidance of doubt, the above statement of invention is that set out in the priority application No GB1021811.3. It is recognised to be narrower than some of the other statements of invention set out above. The following paragraphs down to the description of the drawings are also taken verbatim from the priority application. Their subject matter is not limited to the narrow priority statement of invention, but is applicable to the invention as stated broadly above and indeed as claimed below.

It should also be noted that in these paragraphs, the term:
"enclosure" refers to the "fabrication" of the above paragraphs at least where the fabrication includes a cavity distinct from the void enclosure and
"bulb" refers to the "void enclosure" of the above paragraphs.

Our '744 Application had not yet published been published as of the priority date of this application. Insofar as the present invention is an improvement in the invention of our '744 Application, in its different aspects, as quoted above, LUWPLs including features described in our '744 Application can all be improved with the present invention. Accordingly the following wording in quotation marks below from our '744 Application is repeated for the purposes of disclosure of this invention.

"We determine whether the coupling means is or is not "at least partially inductive" in accordance with whether or not the impedance of the light source, assessed at an input to the coupling means has an inductive component.

"We can envisage certain arrangements in which the coupling means may not be totally surrounded by solid dielectric material. For instance, the coupling means may extend from solid dielectric material in the waveguide space and traverse an air gap therein. However we would not normally expect such air gap to exist.

"The excitable plasma material containing void can be arranged wholly within the second, relatively low average dielectric constant region. Alternatively, it can extend through the Faraday cage and be partially without the cage and the second region.

"In certain embodiments, the second region extends beyond the void in a direction from the inductive coupling means past the void. This is not the case in the first preferred embodiment described below.

"Normally, the fabrication will have at least one cavity distinct from the plasma material void. In such case, the cavity can extend between an enclosure of the void and at least one peripheral wall in the fabrication, the peripheral wall having a thickness less than the extent of the cavity from the enclosure to the peripheral wall.

"In a possible, but not preferred embodiment, the fabrication has at least one external dimension which is smaller than the respective dimension of the Faraday cage, the extent of the portion of the waveguide space between the fabrication and the Faraday cage being empty of solid dielectric material.

"In another possible, but not preferred embodiment, the fabrication is arranged in the Faraday cage spaced from an end of the waveguide space opposite from its end at which the inductive coupler is arranged.

"In another embodiment, the solid dielectric material surrounding the inductive coupling means is the same material as that of the fabrication.

"In the first, preferred embodiment described below, the solid dielectric material surrounding the inductive coupling means is a material of a higher dielectric constant than that of the fabrication's material, the higher dielectric constant material being in a body surrounding the inductive coupling means and arranged adjacent to the fabrication.

"Normally, the Faraday cage will be lucent for light radiation radially thereof. Also the Faraday cage is preferably lucent for light radiation forwardly thereof, that is away from the first, relatively high dielectric constant region of the waveguide space.

"Again, normally the inductive coupling means will be or include an elongate antenna, which can be a plain wire extending in a bore in the body of relatively high dielectric constant material. Normally the bore will be a through bore in the said body with the antenna abutting the fabrication. A counterbore can be provided in the front face of the separate body abutting the rear face of the fabrication and the antenna is T-shaped (in profile) with its T head occupying the counterbore and abutting the fabrication.

"In the case of the third aspect, The difference in front and rear semi-volume volume average of dielectric constant can be caused by the said fabrication having end-to-end asymmetry and/or being asymmetrically positioned in the Faraday cage.

"Preferably:

- the said fabrication occupies the entire waveguide space,
- at least one evacuated or gas-filled cavity is included in the fabrication within the front semi-volume, thereby providing the lower volume average of dielectric constant of the front semi-volume, and
- the cavity extends between the enclosure of the void and at least one peripheral wall in the fabrication, the peripheral wall having a thickness less than the extent of the cavity from the enclosure of the void to the peripheral wall.

"Possibly:

the said fabrication occupies a front part of the waveguide space, a separate body of the same material occupies the rest of the waveguide space and at least one evacuated or gas-filled cavity is included in the fabrication within the front semi-volume, thereby providing the lower volume average of dielectric constant of the front semi-volume, and the cavity extends between the enclosure void and at least one peripheral wall in the fabrication, the peripheral wall having a thickness less than the extent of the cavity from the enclosure of the void to the peripheral wall.

"Further, preferably:

the said fabrication occupies a front part of the entire waveguide space and a separate body of higher dielectric constant material occupies the rest or at least the majority of the waveguide space.

"Where a separate body is used of the same or different dielectric material to that of the fabrication, the inductive coupling means can extend beyond the rear semi-volume into the front semi-volume as far as the fabrication.

"Again, preferably:

at least one evacuated or gas-filled cavity is included in the fabrication within the front semi-volume, thereby enhancing the difference in the dielectric-constant, volume averages between the front and rear semi-volumes, and the cavity extends between the enclosure of the void and at least one peripheral wall in the fabrication, the peripheral wall having a thickness less than the extent of the cavity from the enclosure of the void to the peripheral wall.

"Whilst, the or each cavity can be evacuated and/or gettered, normally the or each cavity will be occupied by a gas, in particular nitrogen, at low pressure of the order of one half to one tenth of an atmosphere. Possibly the or each cavity can be open to the ambient atmosphere[1].

[1] Whilst this paragraph was our preference at the date of our '744 Application, we now prefer that the cavity be gas filled, to a pressure of 5 mbar to 1500 mbar and in particular that it is filled with nitrogen at a pressure of 100 mbar to 700 mbar.

"It is possible for the enclosure void to extend laterally of the cavity, crossing a central axis of the fabrication. However, normally the enclosure of the void will extend on the central longitudinal, i.e. front to rear, axis of the fabrication.

"The enclosure of the void can be connected to both a rear wall and a front wall of the fabrication. However, preferably the enclosure of the void is connected to the front wall only of the fabrication.

"Preferably, the enclosure of the void extends through the front wall and partially through the Faraday cage.

"Possibly the front wall can be domed. However, normally the front wall will be flat and parallel to a rear wall of the fabrication.

"Normally, the enclosure of the void and the rest of the fabrication will be of the same lucent material. Nevertheless, the enclosure of the void and at least outer walls of the fabrication can be of the differing lucent material. For instance, the outer walls can be of cheaper glass for instance borosilicate glass or aluminosilicate glass. Further, the outer wall(s) can be of ultraviolet opaque material.

"In the preferred embodiment, the part of the waveguide space occupied by the fabrication substantially equates to the front semi-volume.

"Where provided, the separate body could be spaced from the fabrication, but preferably it abuts against a rear face of the fabrication and is located laterally by the Faraday cage. The fabrication can have a skirt with the separate body both abutting a rear face of the fabrication and being located laterally within the skirt.

"Preferably the void enclosure is tubular.

"Preferably the fabrication and the separate body of solid dielectric material, where provided, are bodies of rotation about a central longitudinal axis.

"Alternatively, the fabrication and solid body can be of other shapes for instance of rectangular cross-section.

"Conveniently the LUWPL is provided in combination with a electromagnetic wave circuit having:

an input for electromagnetic wave energy from a source thereof and an output connection thereof to the inductive coupling means of the LUWPL;

wherein the electromagnetic wave circuit is a complex impedance circuit configured as a bandpass filter and matching output impedance of the source of electromagnetic wave energy to inductive input impedance of the LUWPL.

"Preferably the electromagnetic wave circuit is a tunable comb line filter; and.

"The electromagnetic wave circuit can comprise:

a metallic housing, a pair of perfect electric conductors (PECs), each grounded inside the housing, a pair of connections connected to the PECs, one for input and the other for output and a respective tuning element provided in the housing opposite the distal end of each PEC.

"A further tuning element can be provided in the iris between the PECs.

"Conveniently, particularly in the case of the third aspect, the fabrication and the alumina body together fill the waveguide space.

"Conveniently, particularly in the case of the fifth aspect:

the inductive coupling means extends as far as the abuttal interface between the body and the fabrication:

the fabrication and the body are of the same material.

"Alternatively:

the body are of differing materials, the body having a higher dielectric constant.

"The separate bodies where provided can be abutted against a rear face of the fabrication and be located laterally by the Faraday cage. However, preferably, the fabrication has a skirt with the separate body both abutting the rear face of the fabrication and being located laterally within the skirt.

"Whilst the body could be of the same lucent material as the enclosure, with the primary difference from the LERs of our WO 2009/063205 application, being the provision of the cavity in which the bulb extends; preferably, the body of solid dielectric material will be of higher dielectric constant than the lucent material of the enclosure and normally will be opaque.

"It should be particularly noted that we expect certain embodiments of the present invention to fall within the scope of the LER patents, because these are broad patents.

"The cavity can be open, allowing air or other ambient gas into the enclosure to substantially surround the bulb. However the cavity will normally be closed and sealed, with either a vacuum in the enclosure or a specifically introduced gas.

"The enclosure and the cavity sealed within it can be of a variety of shapes. Preferably the enclosure is a body of rotation. It could be spherical, hemispherical with a plane back wall for abutting a plane front face of the solid dielectric body, or as in the preferred embodiment, circularly cylindrical, again with a plane back wall for abutting the solid dielectric body.

"Normally the enclosure will have constant thickness walls, whereby the enclosure and the cavity will have the same shape.

"Whilst it is envisaged that the bulb could be spherical, it is preferably elongate with a circular cross-section, typically being formed of tubular material closed at opposite ends, "The bulb can extend into the cavity from a front wall of the enclosure towards its back wall. Alternatively, it can extend from a side wall of the enclosure parallel with the back wall.

"It can also be envisaged that the bulb could extend from the back wall of the enclosure.

"Whilst it can be envisaged that the bulb could be connected to walls of the enclosure at opposite sides/ends of the bulb, it is preferably connected to one wall only. In this way the material of the bulb is substantially thermally isolated from the material of the enclosure; albeit that they are preferably of the same lucent material.

"Normally the bulb, or part of it will be at the centre of the light emitter, experiencing the highest electric field during resonance.

"In a simple arrangement, the enclosure and the solid body can be of equal diameters and abutted together, back wall to front face, being held against each other by the Faraday cage. However it is preferred that the enclosure is extended backwards with a rim fitting a complementary rebate in the body or with a skirt within which the body is received.

"Preferably, the bore in the body for the antenna is central and passes to the front face of the body, whither the antenna extends, with the bulb being arranged to have a portion thereof spaced from the back wall of the enclosure by a small proportion of the enclosure's front to back dimension. In the preferred embodiment, the front face of the body has a recess occupied by a button head of the antenna.

"Alternatively, it can be envisaged that the antenna could be:

- eccentric in the body, either terminating as a rod at the front face of the body or with a button or
- eccentric in the body and extending in to the enclosure, conveniently via an aperture opening in the cavity to ambient, or via a closed end tube extending into the cavity from the back wall whereby the cavity can be sealed.

In all embodiments which we described in our '744 Application, the inductive coupling means is an antenna, preferably with a button head, stopping short of entering the second region or front semi-volume having the lower volume average dielectric constant.

BRIEF DESCRIPTION OF THE DRAWINGS

To help understanding of the invention, specific embodiments thereof will now be described by way of example and with reference to the accompanying drawings, in which.

DETAILED DESCRIPTION OF THE PREFERRED EMBODIMENTS

For the avoidance of doubt the description that follows is that to of our '744 Application, modified in accordance with the present invention. For the assistance of the reader, the wording describing the modification is in italics.

Figure 1:
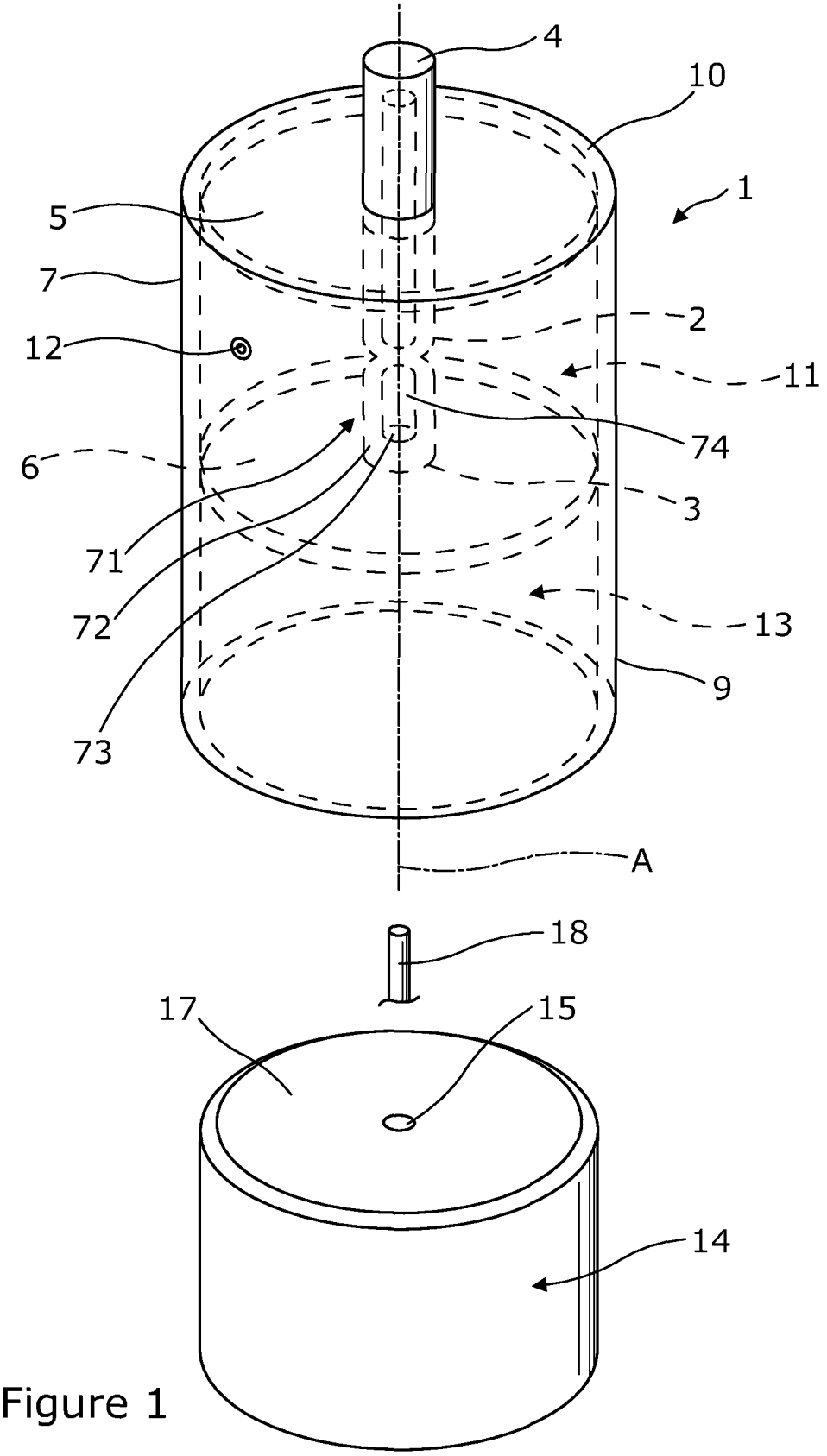
FIG. 1 is an exploded view of a quartz fabrication, an alumina block and an aerial of an LUWPL in accordance with the invention.
Figure 2:
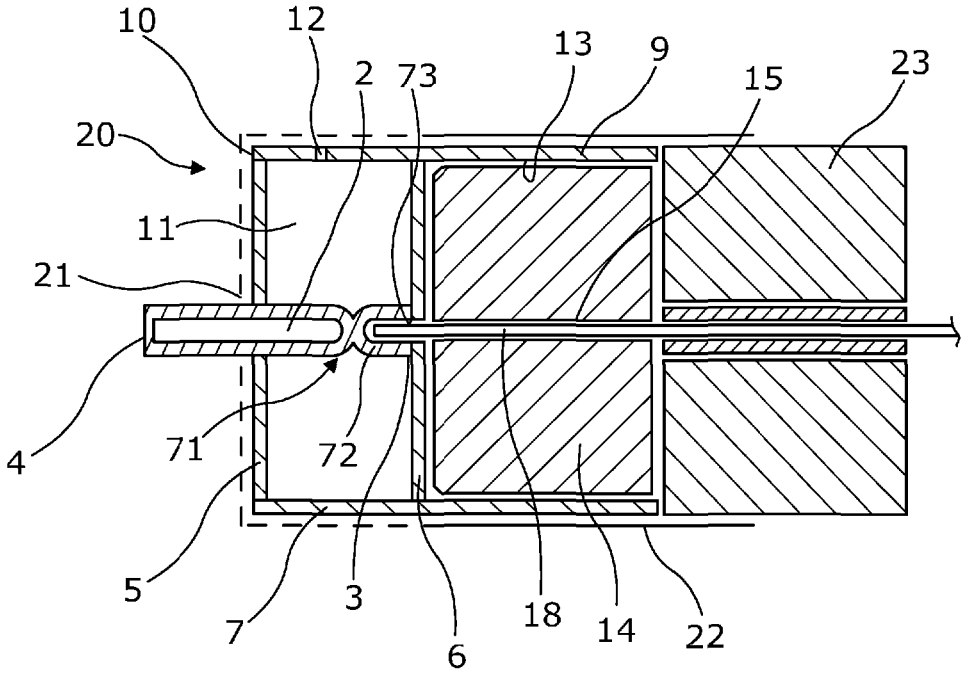
FIG. 2 is a central, cross-sectional side view of the LUWPL of FIG. 1.
Figure 3:
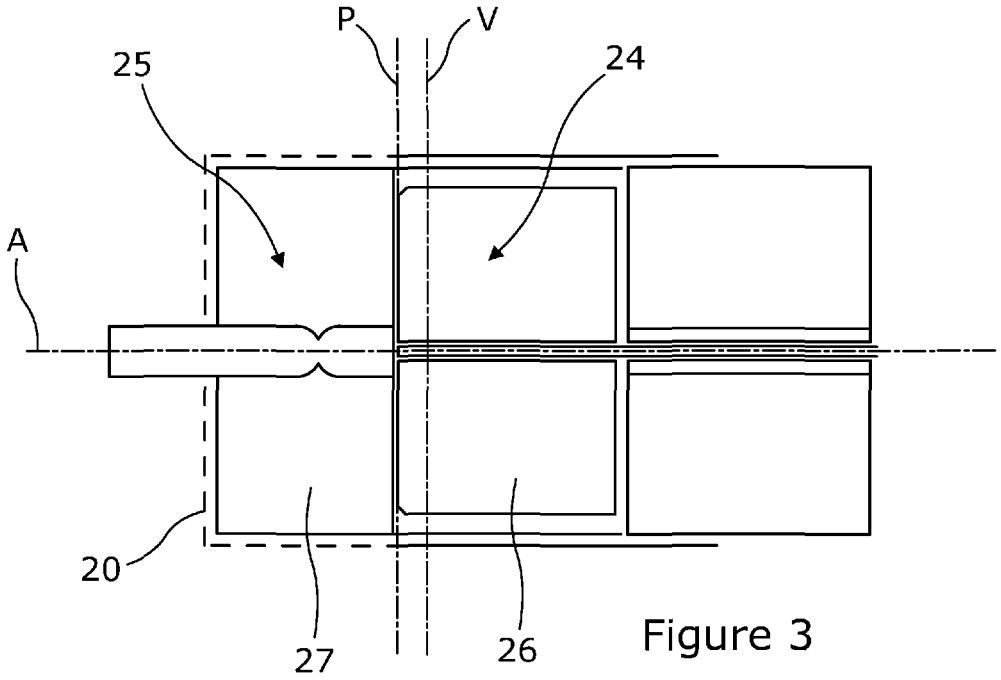
FIG. 3 is a diagrammatic view similar to FIG. 2 of the LWMPLS.

Referring to FIGS. 1 to 3 of the drawings, the Lucent Waveguide Electromagnetic Wave Plasma Light Source has a fabrication 1 of quartz, that is to say fused as opposed to crystalline silica sheet and drawn tube. An inner closed void enclosure 2 is formed of 8 mm outside diameter, 4 mm inside diameter drawn tube. It is sealed at its inner end 3 and its outer end 4. The methods of sealing known from our International Patent Applications Nos WO 2006/070190 and WO2010/094938 are suitable. Microwave excitable plasma material is sealed inside the enclosure. Its outer end 4 protrudes through an end plate 5 by approximately 10.5 mm and the overall length of the enclosure is approximately 20.5 mm The tube 71 from which the void is formed is continued backwards from the inner end of the void enclosure as an antenna sheath 72.

The end plate 5 is circular and has the enclosure 2 sealed in a central bore in it, the bore not being numbered as such. The plate is 2 mm thick. A similar plate 6 is positioned to leave a 10 mm separation between them with a small approximately 2 mm gap between the inner end of the enclosure and the inner plate 6. The antenna sheath is fused to the plate 6, with an aperture 73 in the plate allowing the antenna described below to pass into the sheath. The plates are 34 mm in diameter and sealed in a drawn quartz tube 7, the tube having a 38 mm outside diameter and 2 mm wall thickness. The arrangement places the two tubes concentric with the two plates extending at right angles to their central axis. The concentric axis A and is the central axis of the waveguide as defined below.

The outer end 10 of the outer tube 7 is flush with the outside surface of the outer plate 5 and the inner end of the tube extends 17.5 mm back from the back surface of the inner plate 6 as a skirt 9. This structure provides:

- an annular cavity 11 between the plates, around the void enclosure and within outer tube. The outer tube has a sealed point 12, through which the cavity is evacuated and refilled with low pressure nitrogen having a pressure of the order of one tenth of an atmosphere;
- a skirted recess 13 with the space 74 within it extending into the antenna sheath 72.

Accommodated in the skirted recess is a right-circular-cylindrical block 14 of alumina dimensioned to fit the recess with a sliding fit. Its outside diameter is 33.9 mm and it is 17.7 mm thick. It has a central bore 15 of 2 mm diameter. The rim of the outer face is chamfered against sealing splatter preventing the abuttal being close. An antenna 18 is housed in the bore 15. The antenna is of a length to extend into the antenna sheath 72. The latter has an internal length of 2 mm.

The quartz fabrication 1 is accommodated in hexagonal perforated Faraday cage 20. This extends across the fabrication at the end plate 5 and back along the outer tube for the extent of the cavity 10. The cage has a central aperture 21 for the outer end of the void enclosure and an imperforate skirt 22 extending 8 mm further back than the quartz skirt 9, which accommodates the alumina block 14. An aluminium chassis block 23 carries the fabrication and the alumina body, with the imperforate cage skirt partially overlapping the aluminium block. Thus, the Faraday cage holds these two components together and against the block 23. Not only does the block provide mechanical support, but also electro-magnetic closure of the Faraday cage.

The above dimensions provide for the Faraday cage to be resonant at 2.45 GHz. We believe that the extension of the antenna to within the thickness only of the seal at the inner end of the void enclosure contributes to better transfer of microwave energy from the antenna to the plasma in the void and hence enhancement of efficiency of the LUWPL in terms of lumens of light generated per watt of electricity consumed in powering the LUWPL.

The waveguide space being the volume within the Faraday cage is notionally divided into two regions divided by the plane P at which the alumina block 14 abuts the inner plate 6 of the fabrication. The first inner region 24 contains the antenna, but this has negligible effect on the volume average of the dielectric constant of the material in the region. Within the region are the alumina block and the quartz skirt. These contribute to the volume averages as follows:

Alumina block 14: Volume=$\pi\times(33.9/2)^2\times17.7=15967.7$,
Dielectric constant=9.6,
Volume×Dielectric constant=153289.9.

Quartz Skirt 9 Volume=$\pi\times((38/2)^2-(34/2)^2)\times18=4069.4$,
Dielectric constant=3.75,
Volume×D. constant=15260.3.

First Region 24 Volume=$\pi\times((38/2)^2)\times18=20403.7$
Volume average dielectric constant=(153289.9+15260.3)/20403.7=8.26.

The second region 25 comprises the fabrication less the skirt. Its part contribute to the volume averages as follows:

Void Enclosure Volume=$\pi\times((8/2)^2-(4/2)^2)\times8=301.4$,
Dielectric constant=3.75,
Volume×D. constant=1130.3.

Cavity Enclosure Volume=$\pi\times((38/2)^2-(34/2)^2)\times10=2260.8$,
Dielectric constant=3.75,
Volume×D. constant=8478.1.

Outer Plate Volume=$\pi\times((38/2)^2)\times2=2267.1$,
Dielectric constant=3.75,
Volume×D. constant=8501.6.

Inner Plate Volume=$\pi\times((38/2)^2)\times2=2267.1$,
Dielectric constant=3.75,
Volume×D. constant=8501.6.

Antenna Sheath Volume=$\pi\times((8/2)^2-(4/2)^2)\times2=75.4$,
Dielectric constant=3.75,
Volume×D. constant=282.6.

Cavity Volume=Entire volume less sum of quartz parts=15869.5−301.4−75.4−2260.8−2267.1−2267.1=8773.1,
Dielectric constant=1.00,
Volume×D. constant=8697.7.

Second Region 25 Volume=$\pi\times((38/2)^2)\times14=15869.5$
Volume average dielectric constant=(1130.3+8478.1+8501.6+8501.6+8697.7+282.6)/15869.5=2.24.

It can thus be seen the volume averaged dielectric constant of the first region is markedly higher than that of the second region. This is due to the high dielectric constant of the alumina block. In turn the result of this is that the first region has a predominant effect on the resonant frequency of combination of parts contained within the wave guide. However, the present modification makes negligible difference in this respect.

The contrasting average values for the two regions, 8.26 and 2.24, can be usefully contrasted with the average for the entire waveguide space of (20403.7×8.26)+(15869.5×2.24)/(20403.7+15869.5)=5.62. This figure is not altered significantly by the modification.

If the comparison of regions is not done on the basis of the first and second regions being divided by the abuttal plane between the fabrication and the alumina block, but between the two equal semi-volumes the comparison has an essentially similar result. The division plane V, parallel to the abutment plane, falls 1.85 mm into the alumina block. The latter is uniform in the direction of the axis A. Therefore the volume average of the first, rear semi-volume 26 remains 8.26. The second, other, front semi-volume 27 has a contribution from the slice of alumina and quartz skirt. This contribution can be calculated from its volume average dielectric constant:

1.85 mm slice Volume=$\pi\times(38/2)^2\times1.85=301.4$,
Dielectric constant=8.26,
Volume×D. constant=2097.0.

Front Semi-Volume Volume=$\pi\times((38/2)^2)\times14+\pi\times(38/2)^2\times1.85=15869.5+301.4=16170.9$
Volume average dielectric constant=(15869.5×2.24+2097.0)/16170.9=2.33.

Thus for this particular embodiment, using quartz, alumina, 2 mm wall thickness and an operating frequency of 2.45 GHz, the difference in ratio between:

Front/Rear Regions at 2.24:8.26 as against
Front/Rear Semi-Volumes 2.33:8.26.

This is a Ratio of 0.271:0.281 or 0.96:1.00.

Thus it can be said that the two ratios which are alternative comparisons of the inventive concept of our '744 Application are not affected by the present modification.

It will be noted that this LUWPL is appreciably smaller than an LER quartz crucible operating at 2.45 GHz, eg 49 mm in diameter by 19.7 mm long.

Figure 4:
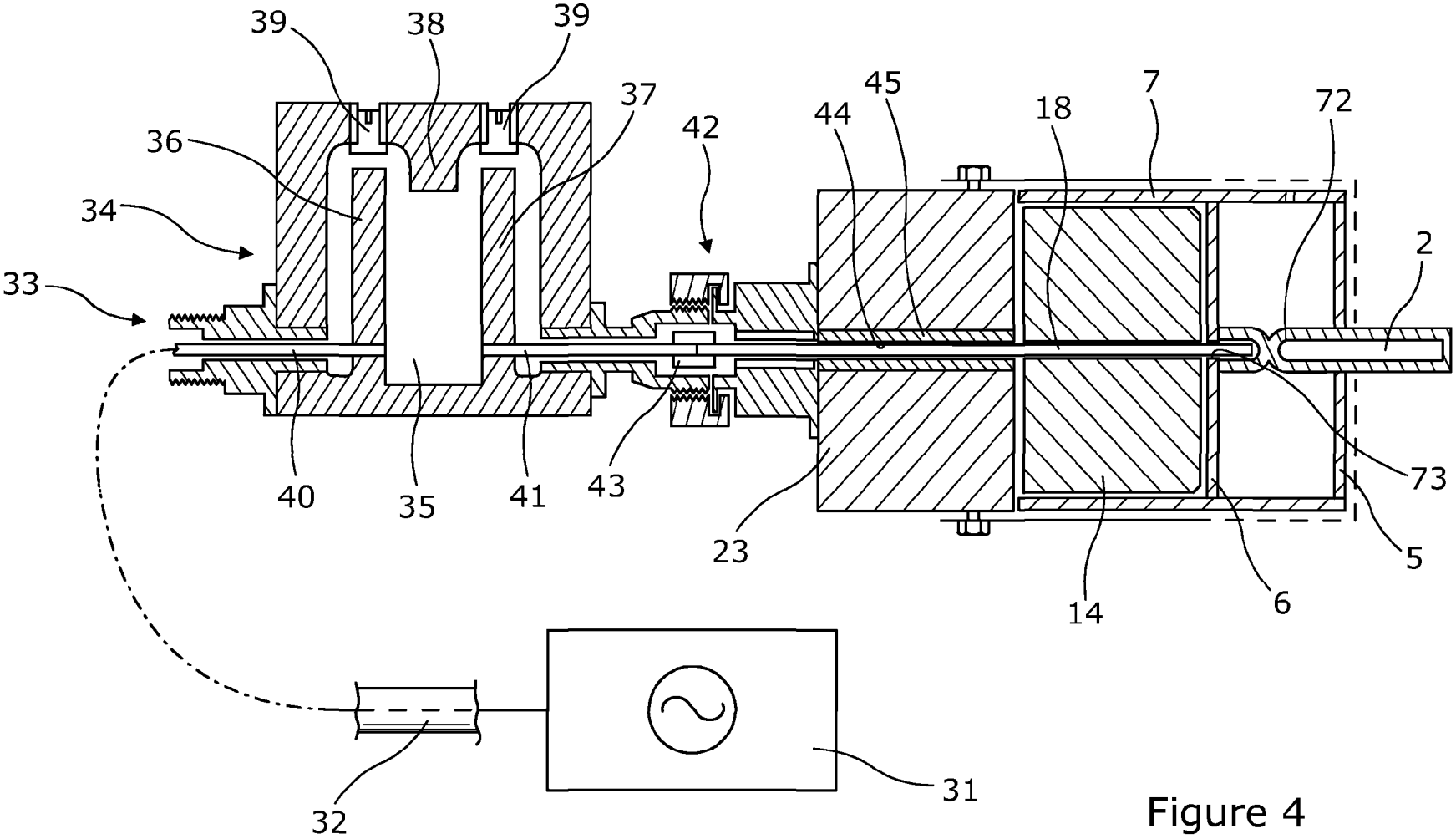
FIG. 4 is a cross-sectional view of the LUWPL of FIG. 1, together with a matching circuit for conducting microwaves to the LUWPL, as arranged for prototype testing.

Turning now to FIG. 4, and bearing in mind that the prototype structure of FIGS. 1 to 3 is dimensioned to operated at 2.45 GHz, FIG. 4 shows a combination of the LUWPL structure and a bandpass filter for matching generated microwaves to the LUWPL. The Figure shows the antenna extending into the sheath. In production at this frequency, these would be generated by a magnetron. In prototype testing, they were generated by a bench oscillator 31 and fed by coaxial cable 32 to the input connector 33 of a band pass filter 34. This is embodied as an air waveguide 35 having two perfect electric conductors (PECs) 36,37 arranged for input and output of microwaves. A third PEC 38 is provided in the iris between the two. Tuning screws 39 are provided opposite the distal ends of the PECs. The input PEC is connected by a wire 40 to the core of the coax cable 32. The output is connected to another wire 41, which is connected through to the antenna 18 via a pair of connectors 42, central to which is a junction sleeve 43. Intermediate the filter 34 and the LUWPL, the aluminium chassis block 23 is provided. It has a bore 44 through which the wire 41 extends, with the interposition of a ceramic insulating sleeve 45.

It should be noted that the arrangement described may not start spontaneously. In prototype operation, the plasma can be initiated by excitation with a Tesla coil device. Alternatively, the noble gas in the void can be radio-active such as Krypton 85 or at least a minor proportion thereof. Again, it is anticipated that the plasma discharge can be initiated by applying a discharge of the automotive ignition type to an electrode positioned close to the end 4 of the void enclosure.

The resonant frequency of the fabrication and alumina block system changes marginally between start up when the plasma is only just establishing and full power when the plasma is full established and acts as a conductor within the plasma void. It is to accommodate this that a bandpass filter, such as described, is used between the microwave generator and the LUWPL.

Figure 5:
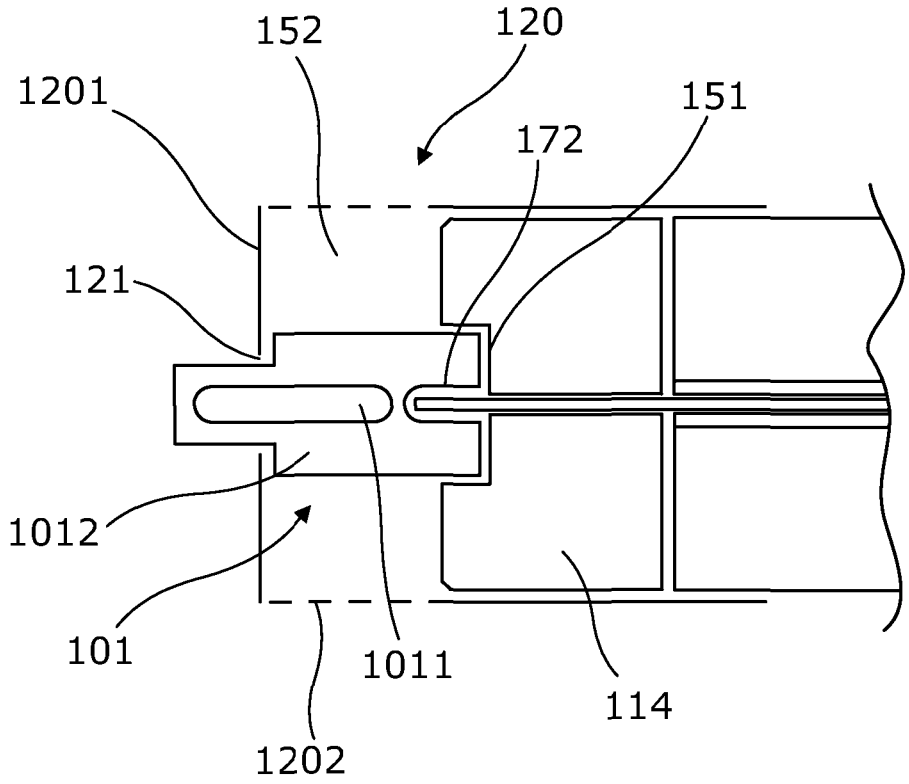
FIG. 5 is a view similar to FIG. 3 of a modified LUWPL.

Turning now to FIG. 5, there is shown a modified LUWPL in which the fabrication 101 has a smaller over all diameter than the alumina block 114 and the Faraday cage 120. The front face of the alumina block has a shallow recess 151 sized to receive and locate the back of the fabrication. The latter is formed with an antenna sheath 172, into which that antenna extends out of the recess 151. The front of the fabrication is located in an aperture 121 in the front of the Faraday cage. This can have a metallic disc 1201 extending laterally to perforated cylindrical portion 1202, through which light can radiate from a plasma in a void 1011 in the fabrication. The arrangement leaves an annular air gap 152 around the fabrication and within the Faraday cage, which contributes to the low volume average dielectric constant of the fabrication region. Whilst an annular cavity such as the cavity 10 could be provided, it would be narrow and it is preferable for the fabrication to be formed with a solid wall 1012 around the void 1011. This variant has the advantage of simpler forming of the fabrication, but is not expected to have such good coupling of microwave energy from the antenna to the plasma. Further light propagating axially of the fabrication will not be able to radiate in this direction through the Faraday cage, being reflected by the disc 1201. However this is not necessarily a disadvantage in that most of the light radiates radially from the fabrication and will be collected for collimation by a reflector (not shown) outside the LUWPL.

Figure 6:
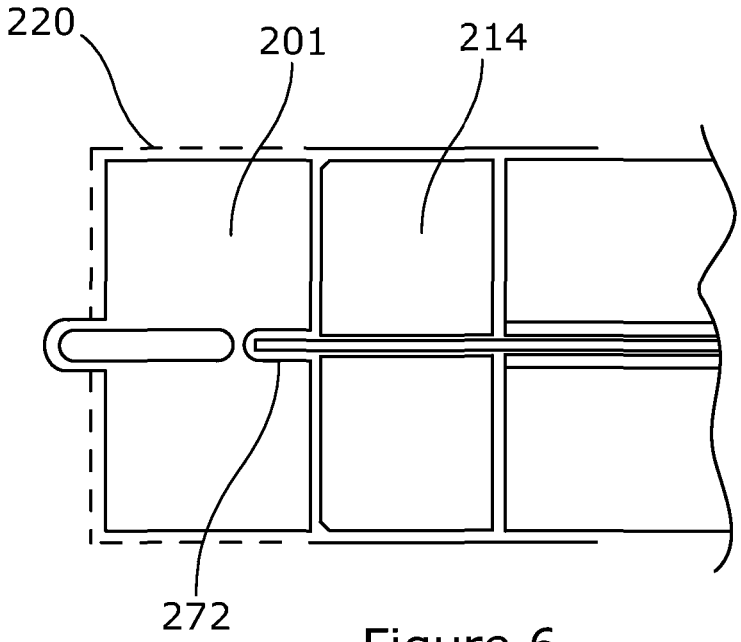
FIG. 6 is a similar view of another modified LUWPL.

Turning to another modified LUWPL as shown in FIG. 6, the fabrication 201 is the same diameter as the alumina block 214 and the Faraday cage 220. However it is of solid quartz. This has a less marked difference of volume average dielectric constant between the regions defined by the fabrication and the block, being the difference between the dielectric constants of their respective materials. The antenna sheath 272 is a bore in the quartz block 201.

Figure 7:
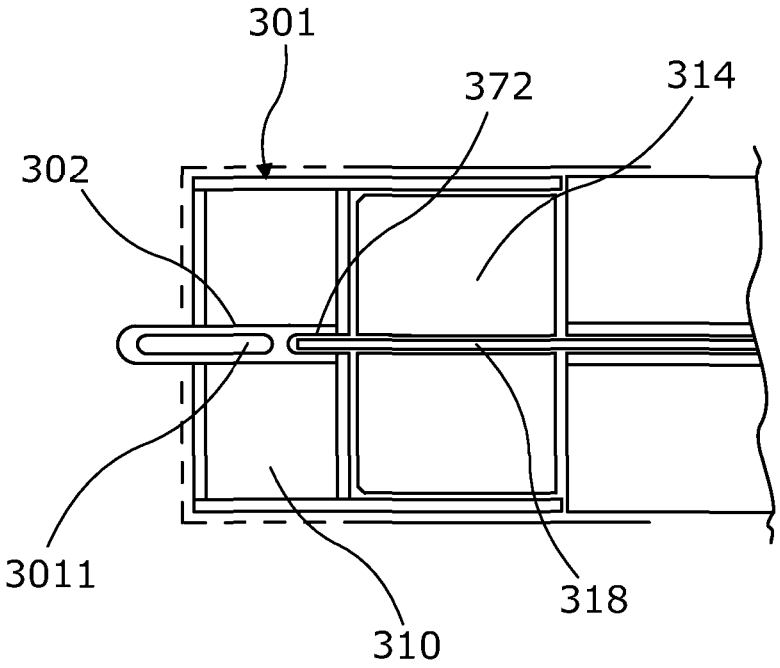
FIG. 7 is a similar view of a third modified LUWPL.

In the modified LUWPL of FIG. 7, the fabrication 301 is effectively identical to that 1 of the first embodiment. The difference is in the solid dielectric block being a quartz block 314. As shown the quartz block is separate from the fabrication. However it could be part of the fabrication, with the antenna sheath 372 extending in front of the back wall of the annular cavity 310. This arrangement would provide fewer interfaces between the antenna 318 and the void 3011. This is believed to be of advantage in enhancing the coupling from the antenna to the void. The dielectric constant volume average difference between the fabrication and the block or at least the solid piece of quartz in which the antenna extends is less, relying on the presence of the annular cavity 310 around the void enclosure 302.

Figure 8:
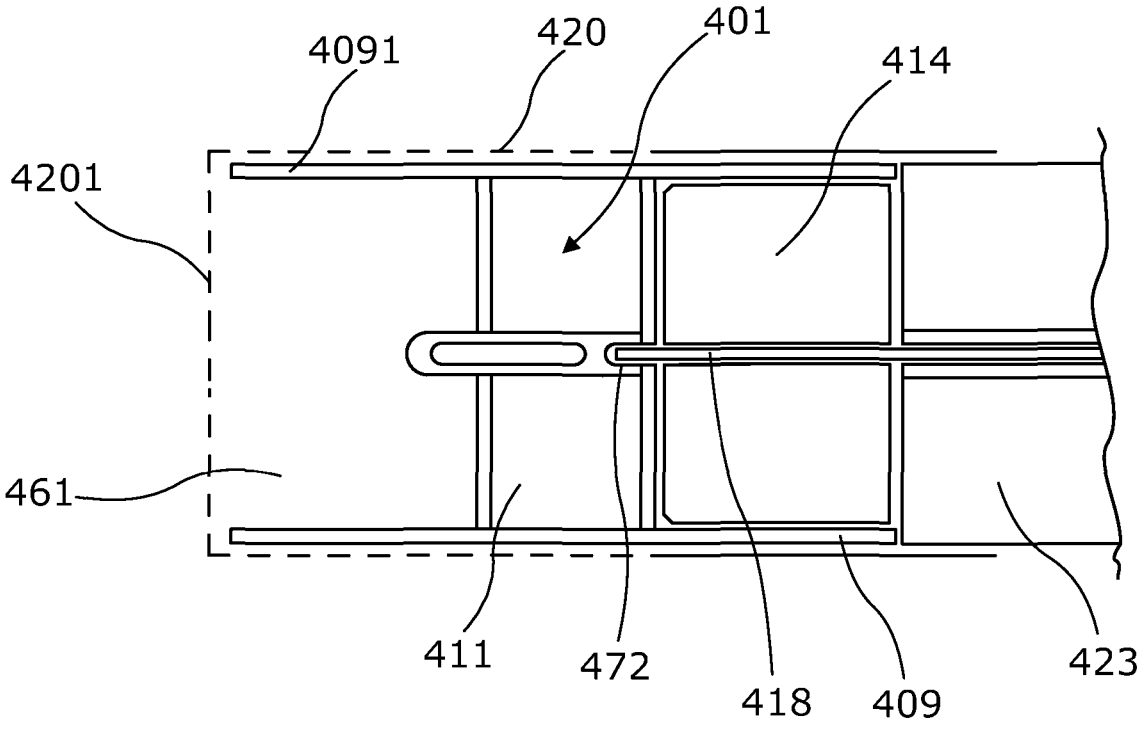
FIG. 8 is a similar view of a fourth modified LUWPL.

In another modification, as shown in FIG. 8, the fabrication 401 has a forward extending skirt 4091 in addition to the skirt 409 around the alumina block 414. With a portion 461 of the waveguide space enclosed within the Faraday cage 420 being empty and thus enhancing the dielectric constant volume average difference. The skirt 4091 supports the Faraday cage and enables the latter at it is front disc 4201, which can be perforate or not, to retain the fabrication and the block against the chassis block 423. Again the antenna sheath 472 and the antenna 418 extend forwards from the back of the cavity 411 of the fabrication surrounding the void enclosure.

Figure 9:
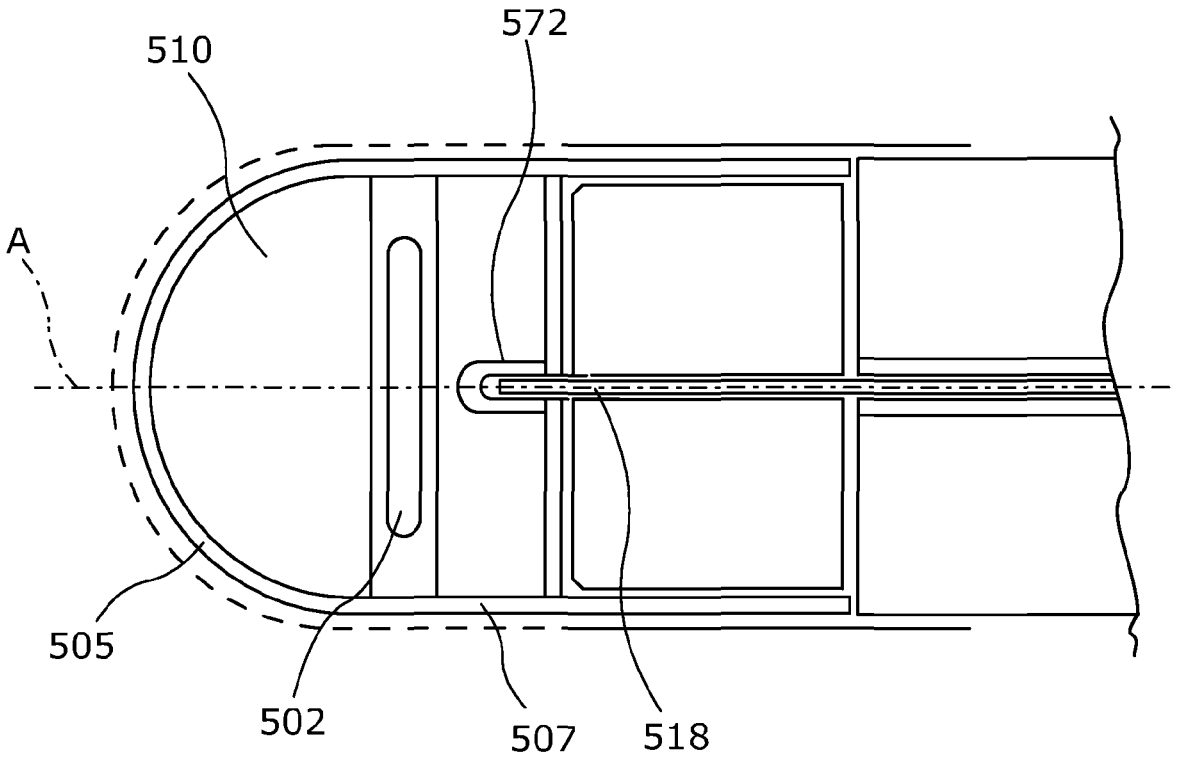
FIG. 9 is a similar view of a fifth modified LUWPL.

In yet another modification, shown in FIG. 9, the fabrication 501 is essentially similar to that 1 of FIGS. 1 & 2 except for two features. Firstly the plasma void enclosure 502 is oriented transversely with respect to the longitudinal axis A of the waveguide space. The enclosure is sealed into opposite sides of the 507 of the cavity 510 of the surrounding the enclosure. Further the front plate is replaced by a dome 505. An antenna sheath 572 allows the antenna 518 to approach closely towards the plasma void enclosure 502.

Figure 10:
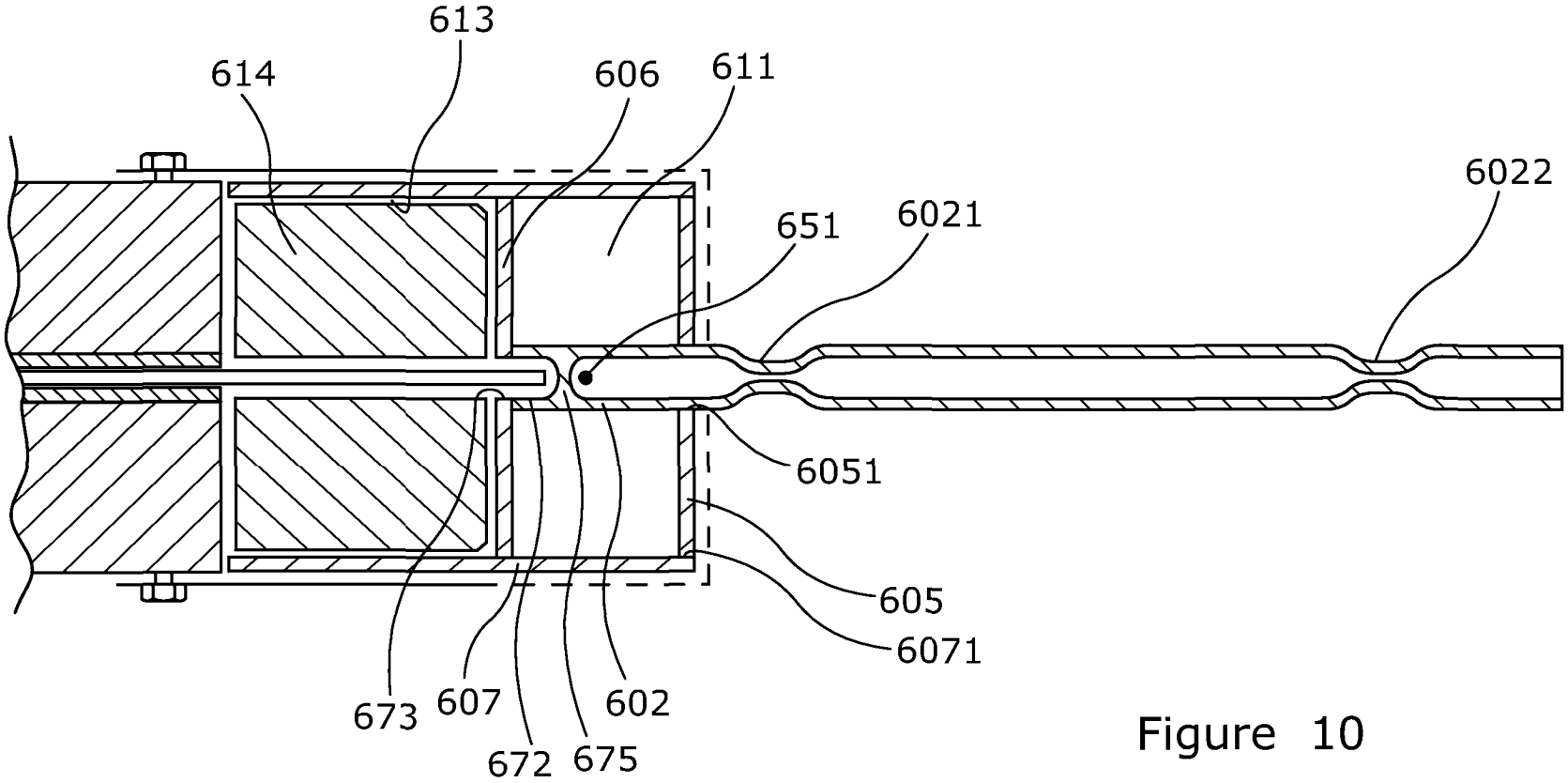
FIG. 10 is a similar view of a sixth modified LUWPL.

Turning to FIG. 10, the LUWPL there shown has a slightly different fabrication to that of FIGS. 1 to 4. It will be described with reference to its method of fabrication:

1. To a disc 606 of quartz, a small diameter tube 602 of quartz is fused centrally, with its bore embodying an antenna sheath 672 in register with a central aperture 673 in the disc 606. At the end of the antenna sheath, the tube is closed as a void closure 675. Also the tube has a near neck 6021 and a far neck 6022;
2. A length 607 of large diameter tube is sealed to the disc 606, in a manner to provide for a cavity 611 and a recess 613 for an alumina block 614 within a skirt 609;
3. A further, front disc 605 of quartz with a central bore 6051 is sealed to the rim 6071 of the large diameter tube and to the smaller diameter tube, with the near neck just outside the front disc;
4. A pellet 651 of microwave excitable material is dropped into the inner tube, coming to rest on the void closure 675. Next the tube is evacuated. Then the disc 606 is heated to cause the pellet to sublime and re-condense in the tube inwards of the near neck 6021. Impurities in the pellet evaporate and are evacuated. The tube is then back-filled with noble gas and sealed at the outer neck;
5. The inner tube is then sealed at the inner neck.

Normally the components that are sealed to form the fabrications will be of quartz which is transparent to a wide spectrum of light. However, where it is desired to restrict the emission of certain coloured light and/or certain invisible light such as ultra-violet light, doped quartz which is opaque to such light can be used for the outer components of the fabrication or indeed for the whole fabrication. Again, other parts of the fabrication, apart from the void enclosure can be made of less expensive glass material.

The invention is not intended to be restricted to the details of the above described embodiments. For instance, the Faraday cage has been described as being reticular where lucent and imperforate around the alumina block and aluminium chassis block. It is formed from 0.12 mm sheet metal. Alternatively, it could be formed of wire mesh. Again the cage can be formed of an indium tin oxide deposit on the fabrication, suitably with a sheet metal cylinder surrounding the alumina and aluminium cylinders. Again where the fabrication and the alumina block are mounted on an aluminium chassis block, no light can leave via the alumina block. Where the alumina block is replaced with quartz, light can pass through this but not through the aluminium block. The block electrically closes the Faraday cage. The imperforate part of the cage can extend back as far as the aluminium block. Indeed the cage can extend onto the back of the quartz with the aluminium block being of reduced diameter.

Another possibility is that there might be an air gap between the fabrication and the alumina block, with the antenna crossing the air gap to extend on into the fabrication. We anticipate that this will normally be via an antenna sheath, to allow the cavity around the void enclosure to be at least partially evacuated. However we envisage that whether there is an air gap or not the antenna may extend on its own into the cavity, with the cavity being in communication with the ambient atmosphere via the aperture passing the antenna. Another possibility is for the aperture to be sealed against the antenna.

Whereas above, the fabrication is said to be of quartz and the higher dielectric constant body is said to be of alumina; the fabrication could be of other lucent material such as polycrystalline alumina and the higher dielectric material body could also be of other high dielectric material such as barium titinate.

As regards frequency of operation, all the dimensional details above are for an operating frequency of 2.45 GHz. It is anticipated that since this LUWPL of the invention can be more compact at any specific operating frequency than an equivalent LER LUWPL, the LUWPLs of this invention will find application at lower frequencies such as 434 MHz (still within the generally accepted definition of the microwave range), due to the balance between greater size due to the longer wavelength of electromagnetic waves and reduced LUWPL size resulting from the invention. For 434 MHz frequency, a solid-state oscillator is expected to be feasible in place of a magnetron, such as is used in productions LUWPLs operating at 2.45 GHz. Such oscillators are expected to be more economic to produce and/or operate.

In all the above embodiments, the fabrication is asymmetric with respect to its central longitudinal axis, particularly due to its normally provided skirt. Nevertheless, it can be anticipated the fabrication could have such symmetry. For instance, the embodiment FIG. 10 would be substantially symmetric if the front seal were finished flush and it did not have a skirt.

Further, the above fabrications are positioned asymmetrically in the waveguide space. Not only is this because the fabrications are not arranged with the inter-region abutment plane P coincident with the semi-volume plane V, but also because the fabrication is towards one end of the waveguide space; whereas the separate solid dielectric material body is towards the other end. Nevertheless, it can be envisaged that the separate body could be united into the fabrication where it is of the same material. In this arrangement, the fabrication is not positioned asymmetrically in the waveguide space. Nevertheless it is asymmetric in itself, with a cavity at one end and being substantially voidless at the other to provided different end to end volume average of its dielectric constant.

Another possible variant is the provision of a forwards extending skirt on the aluminium carrier block. This can be provided with a skirt on the fabrication or not. With it, the Faraday cage can extend back outside the carrier block skirt and be secured to it. Alternatively, where the cage is a deposit on the fabrication, the carrier block skirted can be urged radially inwards onto the deposited cage material for contact with it.

The invention is not intended to be restricted to the details of the above described embodiments. For instance, the void enclosure runs a lot hotter than the outer tube enclosing the annular cavity. To avoid high thermal stresses in the quartz fabrication, the antenna sheath can be separate from the void enclosure in a manner similar to FIG. 9, where the antenna sheath and the void enclosure are separated by a gap. This can be envisaged with reference to FIG. 2 as a break in the continuity of the quartz thereshown between the void enclosure 2 and the antenna sheath 72. In this envisaged variant, the void enclosure is oriented axially as in the other embodiments, with the gap being on the central axis between the void enclosure and the antenna sheath.

In a variant of the embodiment of FIG. 9, the void enclosure can extend from one end on one side of the annular cavity only, being spaced from the outer tube at its other end.

Figure 11:
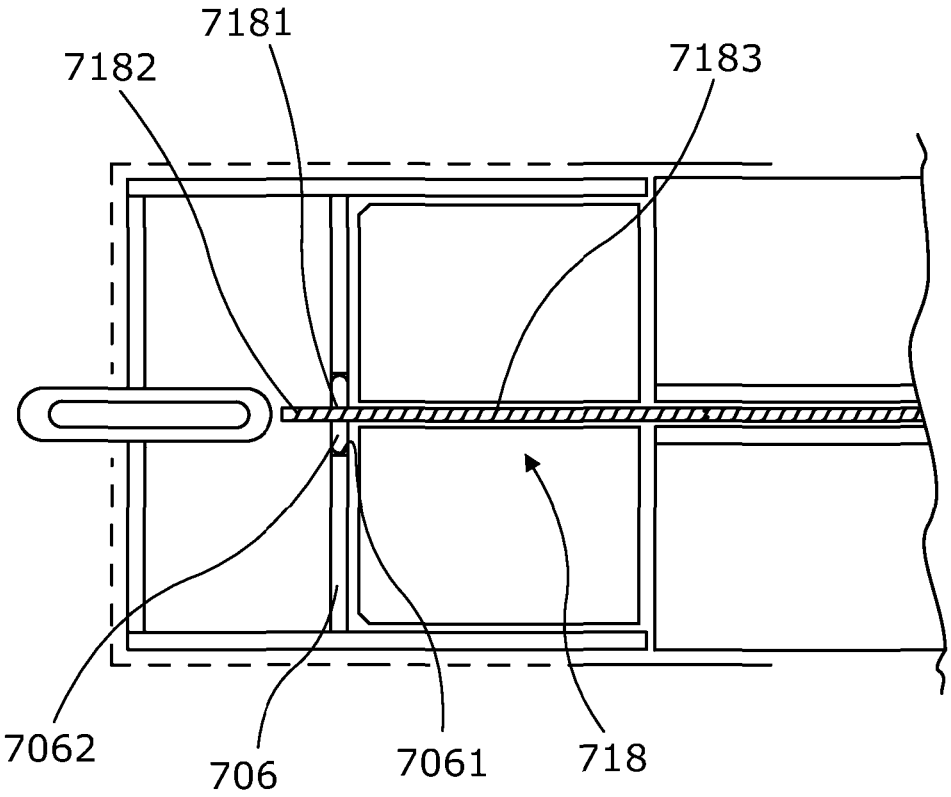
FIG. 11 is a view similar to FIG. 2 of a varied LUWPL.

In another variant, described with reference to FIG. 11, the antenna 718 need not extend in an antenna sheath, but rather extends in a sealed manner into the outer enclosure. It can do this via a sealed aperture 7061 in the inner end plate 706. To avoid thermal stresses, the antenna preferably has a tungsten mid-section 7181 passing through the inner plate, with inner and outer, welded-on ends 7182,7183 of copper. Inevitably, the antenna has a greater coefficient of expansion than fused quartz, at 4.5 to $0.5\times10^{-6}$. To accommodate this difference, a seal 7062 of aluminosilicate glass with an intermediate coefficient of expansion is used in the aperture 7061.

The invention claimed is:

1. A Lucent Waveguide Electromagnetic Wave Plasma Light Source (LUWPL) comprising:

a fabrication of solid-dielectric, lucent material, the fabrication providing at least:

a closed void containing electromagnetic wave excitable plasma material;

a Faraday cage:

at least substantially enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

the arrangement being such that there is:

a first region of the waveguide space extending between opposite sides of the Faraday cage at this region, this first region:

at least partially accommodating the inductive coupling means and having a relatively high volume average dielectric constant and a second region of the waveguide space extending between opposite sides of the Faraday cage at this region, this second region:

having a relatively low volume average dielectric constant as compared to that of the first region, and being occupied by:

the fabrication of solid-dielectric, lucent material and either the closed void containing electromagnetic wave excitable plasma material alone or the closed void containing electromagnetic wave excitable plasma material and a cavity within the fabrication or the closed void containing electromagnetic wave excitable plasma material and an empty portion of the waveguide space between the fabrication and the Faraday cage or the closed void containing electromagnetic wave excitable plasma material and both a cavity within the fabrication and an empty portion of the waveguide space between the fabrication and the Faraday cage;

wherein:

the at least partially inductive coupling means for introducing plasma exciting electromagnetic waves into the waveguide extends out of the first region and into the second region.

2. A LUWPL according to claim 1, wherein the at least partially inductive coupling means extends to a position in the second region of the waveguide space at which a portion of the second region unoccupied by solid-dielectric material is present between the coupling means and the Faraday cage.

3. A LUWPL according to claim 1, wherein a solid-dielectric material surface extends at least substantially between opposite sides of the Faraday cage, preferably as a face of the lucent material of the fabrication, as an interface between the first and second regions of the waveguide space.

4. A LUWPL according to claim 1, wherein the at least partially inductive coupling means is an antenna extending through an aperture in a back wall of the fabrication, into a cavity therein without any sheath, preferably being sealed in the back wall.

5. A LUWPL according to claim 1, wherein the at least partially inductive coupling means is an antenna extending into the fabrication within a sheathing tube, preferably coaxial with the closed void.

6. A LUWPL according to claim 5, wherein the sheathing tube is of the material of the fabrication and preferably is a continuation of a tube enclosing the closed void therein.

7. A LUWPL according to claim 5, wherein the sheathing tube is of the material of the fabrication and is discontinuous from a tube enclosing the closed void therein.

8. A LUWPL according to claim 5, wherein there exists only a single piece of fabrication material between the antenna and the closed void.

9. A LUWPL according to claim 1, wherein:

the excitable plasma material containing void is arranged wholly within the second, relatively low average dielectric constant region, preferably with the second region extending beyond the void in a direction from the inductive coupling means past the void; or the excitable plasma material containing void is arranged to extend through the Faraday cage and be partially without the cage and the second region, the fabrication being otherwise enclosed by the Faraday cage.

10. A LUWPL according to claim 1, wherein:

the fabrication has at least one cavity distinct from the plasma material void and preferably the cavity extends between an enclosure of the void and at least one peripheral wall in the fabrication, the peripheral wall having a thickness less than the extent of the cavity from the enclosure to the peripheral wall.

11. A LUWPL according to claim 1, wherein:

the fabrication has at least one external dimension which is smaller than the respective dimension of the Faraday cage, the extent of the portion of the waveguide space between the fabrication and the Faraday cage being empty of solid dielectric material and/or the fabrication is arranged in the Faraday cage spaced from an end of the waveguide space opposite from its end at which the inductive coupler is arranged.

12. A LUWPL according to claim 1, wherein:

the solid dielectric material surrounding the inductive coupling means is the same material as that of the fabrication or the solid dielectric material surrounding the inductive coupling means is a material of a higher dielectric constant than that of the fabrication's material, the higher dielectric constant material being in a body surrounding the inductive coupling means and arranged adjacent to the fabrication and preferably the inductive coupling means is or includes an elongate antenna extending in a bore in the surrounding solid dielectric material.

13. A LUWPL according to claim 1, wherein:

the Faraday cage is lucent for light radiation radially thereof and/or the Faraday cage is lucent for light radiation forwardly thereof, that is away from the first, relatively high dielectric constant region of the waveguide space.

14. A LUWPL according to claim 1, wherein:

the inductive coupling means is or includes an elongate antenna;

the antenna is a plain wire extending in a bore in the relatively high dielectric constant material.

15. A LUWPL according to claim 1, wherein the void enclosure is tubular and preferably the fabrication and the separate body of solid dielectric material, where provided, are bodies of rotation about a central longitudinal axis or the fabrication and the separate body of solid dielectric material, where provided, are of rectangular cross-section.

16. A LUWPL according to claim 1 in combination with a electromagnetic wave circuit having:

an input for electromagnetic wave energy from a source thereof and an output connection thereof to the inductive coupling means of the LUWPL;

wherein the electromagnetic wave circuit is a complex impedance circuit configured as a bandpass filter and matching output impedance of the source of electromagnetic wave energy to the inductive input impedance of the LUWPL, and preferably the electromagnetic wave circuit is a tunable comb line filter, comprising:

a metallic housing, a pair of perfect electric conductors (PECs), each grounded inside the housing, a pair of connections connected to the PECs, one for input and the other for output and a respective tuning element provided in the housing opposite the distal end of each PEC, and preferably a further tuning element provided in the iris between the PECs.

17. A Lucent Waveguide Electromagnetic Wave Plasma Light Source (LUWPL) comprising:

a fabrication of solid-dielectric, lucent material, the fabrication providing at least:

an enclosure of a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space and the waveguide space having an axis of symmetry; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the arrangement is such that with the waveguide space notionally divided into equal front and rear semi-volumes:

the front semi-volume is:

at least partially occupied by the fabrication with the said void in the front semi-volume and is at least partially enclosed by a front, lucent portion of the Faraday cage via which portion light from the void can radiate, the rear semi-volume has the at least partially inductive coupling means extending in it and the volume average of the dielectric constant of the content of the front semi-volume is less than that of the rear semi-volume:

wherein:

the at least partially inductive coupling means for introducing plasma exciting electromagnetic waves into the waveguide extends out of the rear semi-volume and into the front semi-volume.

18. A LUWPL according to claim 17, wherein the at least partially inductive coupling means extends to a position in the second region of the waveguide space at which a portion of the second region unoccupied by solid-dielectric material is present between the coupling means and the Faraday cage.

19. A LUWPL according to claim 17, wherein a solid-dielectric material surface extends at least substantially between opposite sides of the Faraday cage, preferably as a face of the lucent material of the fabrication, as an interface between the first and second regions of the waveguide space.

20. A LUWPL according to claim 17, wherein the at least partially inductive coupling means is an antenna extending through an aperture in a back wall of the fabrication, into a cavity therein without any sheath, preferably being sealed in the back wall.

21. A LUWPL according to claim 17, wherein the at least partially inductive coupling means is an antenna extending into the fabrication within a sheathing tube, preferably coaxial with the closed void.

22. A LUWPL according to claim 17, wherein there exists only a single piece of fabrication material between the at least partially inductive coupling means and the closed void.

23. A LUWPL according to claim 17, wherein the difference in front and rear semi-volume volume average of dielectric constant is caused by the said fabrication having end-to-end asymmetry and/or being asymmetrically positioned in the Faraday cage.

24. A LUWPL according to claim 17, wherein:

the said fabrication occupies the entire waveguide space, at least one evacuated or gas-filled cavity is included in the fabrication within the front semi-volume, thereby providing the lower volume average of dielectric constant of the front semi-volume, and the cavity extends between the enclosure of the void and at least one peripheral wall in the fabrication, the peripheral wall having a thickness less than the extent of the cavity from the enclosure of the void to the peripheral wall.

25. A LUWPL according to claim 24, wherein:

the or each cavity is evacuated and/or gettered or the or each cavity is occupied be a gas at a pressure of 5 mbar (0.5 kPa) to 1500 mbar (150 kPa) and preferably at a pressure of 100 mbar (10 kPa) to 700 mbar (70 kPa) and the gas is preferably nitrogen.

26. A LUWPL according to claim 17, wherein:

the said fabrication occupies a front part of the waveguide space and a separate body of the same material occupies the rest of the waveguide space and at least one evacuated or gas-filled cavity is included in the fabrication within the front semi-volume, thereby providing the lower volume average of dielectric constant of the front semi-volume, and the cavity extends between the enclosure void and at least one peripheral wall in the fabrication, the peripheral wall having a thickness less than the extent of the cavity from the enclosure of the void to the peripheral wall; or a separate body of higher dielectric constant material occupies the rest or at least the majority of the waveguide space and preferably:

at least one evacuated or gas-filled cavity is included in the fabrication within the front semi-volume, thereby enhancing the difference in the dielectric-constant, volume averages between the front and rear semi-volumes, and the cavity extends between the enclosure of the void and at least one peripheral wall in the fabrication, the peripheral wall having a thickness less than the extent of the cavity from the enclosure of the void to the peripheral wall.

27. A LUWPL according to claim 26, wherein:

the separate body abuts against a rear face of the fabrication and is located laterally by the Faraday cage, or the separate body is spaced by an air gap from a rear face of the fabrication and is located laterally by the Faraday cage and preferably the fabrication has a skirt with the separate body both abutting a rear face of the fabrication and being located laterally within the skirt.

28. A LUWPL according to claim 17, wherein the enclosure void extends laterally of the cavity, crossing a central axis of the fabrication.

29. A LUWPL according to claim 17, wherein:

the enclosure of the void extends on a central longitudinal, i.e. front to rear, axis of the fabrication and preferably the enclosure of the void is connected to both a rear wall and a front wall of the fabrication or the enclosure of the void is connected to the front wall only of the fabrication.

30. A LUWPL according to claim 29, wherein the enclosure of the void extends through the front wall and partially through the Faraday cage.

31. A LUWPL according to claim 29, wherein:

the front wall is domed or the front wall is flat and parallel to a rear wall of the fabrication.

32. A LUWPL according to claim 17, wherein:

the enclosure of the void and the rest of the fabrication are of the same lucent material or the enclosure of the void and at least outer walls of the fabrication are of the differing lucent material and preferably the outer wall(s) are of ultraviolet opaque material.

33. A LUWPL according to claim 17, wherein the part of the waveguide space occupied by the fabrication substantially equates to the front semi-volume.

34. A Lucent Waveguide Electromagnetic Wave Plasma Light Source (LUWPL) comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the fabrication is of quartz and a body of alumina is provided in the waveguide space to raise the volume average of the dielectric constant of the waveguide space, the inductive coupling means being provided at least partially in the alumina body;

wherein:

the at least partially inductive coupling means for introducing plasma exciting electromagnetic waves into the waveguide extends out of the alumina body and into the quartz fabrication.

35. A LUWPL according to claim 34, wherein the fabrication and the alumina body together fill the waveguide space.

36. A Lucent Waveguide Electromagnetic Wave Plasma Light Source (LUWPL) comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, at least a part of the fabrication therein; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the volume average of the dielectric constant of the fabrication is less that the dielectric constant of its material; and the at least partially inductive coupling means for introducing plasma exciting electromagnetic waves into the waveguide extends into the fabrication having the closed void.

37. A Lucent Waveguide Electromagnetic Wave Plasma Light Source (LUWPL) comprising:

a fabrication of solid-dielectric, lucent material, the fabrication providing at least:

a closed void containing electromagnetic wave excitable plasma material;

a Faraday cage:

enclosing the fabrication, being at least partially lucent, for light emission from it and delimiting a waveguide, the waveguide having:

a waveguide space, the fabrication occupying at least part of the waveguide space; and at least partially inductive coupling means for introducing plasma exciting electromagnetic waves into the waveguide at a position at least substantially surrounded by solid dielectric material;

whereby on introduction of electromagnetic waves of a determined frequency a plasma is established in the void and light is emitted via the Faraday cage;

wherein:

the Light Source further comprises a body of solid dielectric material in the waveguide space, the body abutting the fabrication and having the inductive coupling means extending in it, and the at least partially inductive coupling means for introducing plasma exciting electromagnetic waves into the waveguide extends out of the said body and into the second fabrication.

38. A LUWPL according to claim 37, wherein:

the fabrication and the body are of the same material, or the fabrication and the body are of differing materials, the body having a higher dielectric constant.

* * * * *